US005402503A

United States Patent [19]

Prokisch

[11] Patent Number: 5,402,503

[45] Date of Patent: Mar. 28, 1995

[54] LIGHT-WEIGHT CONICAL LOUDSPEAKER

[75] Inventor: Jörg Prokisch, Schwarzach, Germany

[73] Assignee: Nokia Technology GmbH, Pforzheim, Germany

[21] Appl. No.: 129,755

[22] Filed: Sep. 30, 1993

[30] Foreign Application Priority Data

Oct. 9, 1992 [DE] Germany ..... 42 34 069.1

[51] Int. Cl.[6] ..... H04R 25/00

[52] U.S. Cl. ..... 381/199; 381/192

[58] Field of Search ..... 381/199, 194, 192, 201, 381/196, 188, 195, 197

[56] References Cited

U.S. PATENT DOCUMENTS

| | | | |
|---|---|---|---|
| 4,427,845 | 1/1984 | Yoshida | 381/199 |
| 4,737,992 | 4/1988 | Latham-Brown et al. | 381/194 |
| 5,033,093 | 7/1991 | Tardo | 381/188 |

FOREIGN PATENT DOCUMENTS

| | | | |
|---|---|---|---|
| 0341926 | 5/1989 | European Pat. Off. . | |
| 0965754 | 9/1950 | France | 381/199 |
| 1096422 | 1/1955 | France | 381/199 |
| 2900427 | 8/1979 | Germany . | |
| 2936965 | 3/1981 | Germany . | |
| 3339720 | 5/1985 | Germany . | |
| 3638693 | 11/1986 | Germany . | |
| 0057398 | 5/1981 | Japan | 381/199 |
| 0220899 | 8/1982 | Japan | 381/199 |
| 0499830 | 1/1939 | United Kingdom | 381/199 |
| 9206569 | 8/1991 | WIPO . | |

*Primary Examiner*—Curtis Kuntz
*Assistant Examiner*—Huyen D. Le
*Attorney, Agent, or Firm*—Ware, Fessola, Van der Sluys & Adolphson

[57] ABSTRACT

It is known in the state of the art to equip conical loudspeakers, which are suitable for reproducing long excursion or wide band audio signals, with magnet systems (10), which contain a ring-shaped permanent magnet (12) made of ferrite. To make the induction, required by these magnet systems (10), available in the air gap (20), it is necessary to design the permanent magnets (12) in a large size. It is also known to construct short excursion magnet systems in such a way, that the pole core is made of a high energy magnetic material (-neodymium). This pole core is located in the center of a pot magnet. Such magnet systems, which have the same output and can be built considerably smaller and lighter than the types of magnet systems (10) mentioned first, cannot be transferred to the magnet systems (10) that are suitable for the reproduction of wide band or long excursion audio signals, because a neodymium pole core is not able to produce the induction in the air gap required by such magnet systems (10). The invention therefore equips a conventional magnet system (10) with a pole core (13), which is at least partly made of neodymium. This measure makes it possible to lighten the magnet system by at least 50%, as compared to conventional magnet systems (10), with the same induction in the air gap (20) and the same air gap dimensions.

5 Claims, 1 Drawing Sheet

LIGHT-WEIGHT CONICAL LOUDSPEAKER

TECHNICAL FIELD

This invention relates to the development of conical loudspeakers, in particular to the weight reduction of long excursion conical loudspeakers.

BACKGROUND OF THE INVENTION

The construction and operation of conical loudspeakers are well known in the state of the art, so that a broader discussion can be omitted in this instance.

The magnet system of such conical loudspeakers usually consists of a ring-shaped permanent magnet, an upper and a lower pole plate and a pole core. The pole core is centrally located on the lower pole plate, and is surrounded at a distance by the ring-shaped permanent magnet, the ring surface of which is also connected to the lower pole plate. The upper, equally ring-shaped pole plate is located on the other ring surface of the permanent magnet. The length of the pole core is so dimensioned, that the free end of the pole core, which is not connected to the lower pole plate, closes off the upper pole plate when the magnet system is installed, where the inside border of the upper pole plate surrounds the pole core at a distance. The voice coil, which is connected to the loudspeaker diaphragm, enters into this gap, commonly called an air gap. Except for permanent magnets made of ferrite, which already receive the necessary shape during the sintering process, all other components of the magnet system are either stamped or extruded.

A disadvantage of such magnet systems is that such loudspeakers are very heavy. This can be attributed to the fact that large, and therefore heavy, permanent magnets are required to produce sufficient induction in the air gap. This applies particularly when loudspeakers with large excursion voice coils are driven by such magnet system. In that instance it is necessary to select a larger winding width of the voice coil and a greater height of the pole plate, than in situations where the magnet system is designed for short excursion reproduction. The result is that, because of the greater thickness of the upper pole plate or the larger winding width of the voice coil in such long excursion magnet systems, the required induction in the air gap can only be produced by the superproportional enlargement of the permanent magnet, as compared to short excursion systems.

In addition to this magnet system configuration, high and mid-range magnet systems are known, which differ in construction from the above-named magnet systems. Such magnet systems have a pot magnet, on the bottom of which the pole core is centrally located with respect to the loudspeakers axis. The pole core in this configuration is made of a high energy magnetic material, known as neodymium. The end of the pole core that is not connected to the bottom of the pot is equipped with an upper pole plate, which has a larger diameter than the pole core. The height of the pot edge coincides with the height of the pole core and the pole plate. The pot edge and the components in the pot (pole core and pole plate) are usually of the same height. The magnet system's air gap is formed between the upper pot edge and the pole plate, since the two components are at a distance from each other. The upper part of the pot edge, in other words the part facing the pole plate, can be pole-shaped, by letting this part of the pot edge protrude inside the pot. Such magnet systems have the advantage that they can be built clearly lighter, as opposed to comparable loudspeakers with permanent magnets made exclusively of ferrite. However, this applies only to magnet systems that operate with short excursion. These are above all high and mid-range loudspeakers. This can be attributed to the fact that, in spite of the superior characteristics of neodymium, the required induction in the air gap is only suitable for narrow winding widths of the voice coil. Furthermore, the neodymium magnet system has the disadvantage that the pot magnet must be turned on a lathe, and is therefore more expensive to produce than the above described pure ferrite systems. However, even if this disadvantage is not taken into consideration, and it is attempted to also build long excursion magnet systems in the above described manner, it is not possible to transfer the neodymium magnet systems used in short excursion operation to the long excursion magnet systems. The reason is that this type of loudspeaker requires a larger constructed size and greater induction in the air gap, because of the larger excursion, as compared to high and mid-range loudspeakers. This cannot be achieved satisfactorily by enlarging the neodymium pole core.

For that reason, the invention has the task of providing a conical loudspeaker, in particular a magnet system for long excursion conical loudspeakers, which has a clearly lower weight by comparison to known magnet systems whose permanent magnets are made exclusively of ferrite.

SUMMARY OF THE INVENTION

This task is fulfilled in that at least part of the pole core is made of neodymium, in that equal poles of the pole core and the permanent magnet face in opposite directions with respect to the loudspeaker axis, and that the upper pole plate is made of two parts, where one part is ring-shaped and is connected to the permanent magnet, and the other part of the pole plate is disk-shaped and is connected to the pole core.

This kind of magnet system construction permits long excursion design magnet systems for conical loudspeakers, with 50% savings in weight as compared to ferrite magnet systems. Long excursion magnet systems are understood to be those magnet systems whose voice coil moves more than 3 mm.

If the pole core is in the form of a neodymium disk which rests on a base formed on the lower pole plate, it has the advantage of minimizing the use of neodymium. If the entire pole core is made of neodymium, the great height of the pole core for long excursion magnet systems causes the induction in the air gap to be only negligibly larger than in the case where a relatively thin neodymium disk is located in the pole core.

A significant induction increase in the air gap is achieved when another neodymium disk is located on the side of the disk-shaped part of the upper pole plate that faces away from the lower pole plate, and equal poles of the other neodymium disk and the pole core face each other.

BEST MODE FOR CARRYING OUT THE INVENTION

The invention will now be explained in detail by means of the figures.

Figure 1:
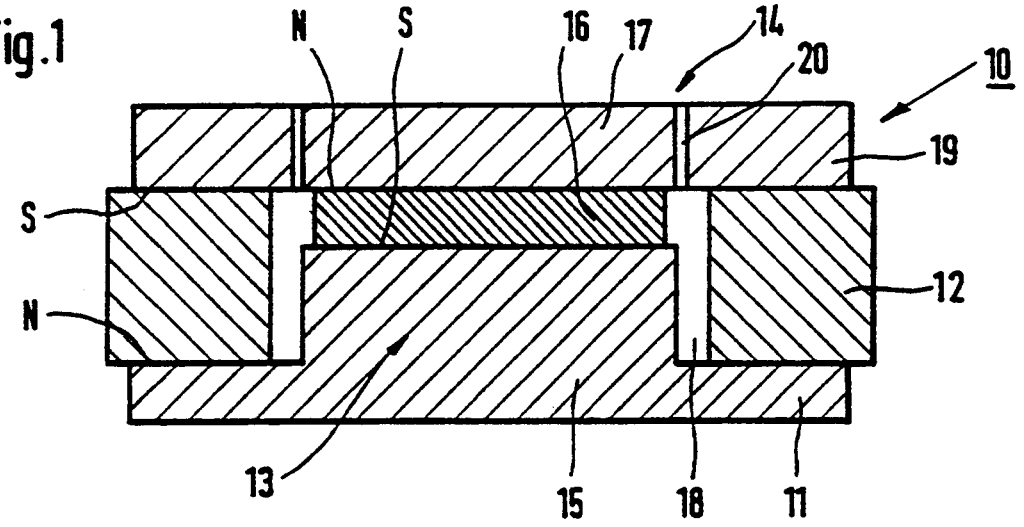
FIG. 1 is a cross-sectional view of a magnet system according to the invention.

FIG. 1 shows a cross-section of magnet system 10 for conical loudspeakers. The cross-section in this figure, as well as in the other figures, is through the area of the magnet system 10 where the largest diameter is located. The magnet system 10, which is depicted in FIG. 1 and is designed to reproduce wide band audio signals, consists essentially of the lower pole plate 11, the ring-shaped permanent magnet 12, the pole core 13 and the upper pole plate 14. All these components or groups of components are either stamped or extruded, or were already shaped during the sintering process. The latter makes the development of a magnet system 10 in accordance with FIG. 1 particularly cost effective.

The lower pole plate 11 is connected to the lower side of the ring surface of the permanent magnet 12 made of ferrite. The pole core 13, which is centrally located with respect to the axis of magnet system 10, consists of a base 15 formed on the lower pole plate 11, a neodymium disk 16 placed thereon, and a disk 17 located on the neodymium disk 16. In the configuration example illustrated here, the base 15 and the disk 17 have the same outside diameter. The diameter of the neodymium disk 16 is somewhat smaller than the parts mentioned last. In another configuration example not shown here, the diameter of the neodymium disk 16 may correspond to the diameter of the base 15 or the disk 17.

The gap 18 is formed between the inner wall of the permanent magnet 12 and the base 15, as well as the neodymium disk 16. The neodymium disk 16, which is connected to the base 15, is flush with the upper ring surface of the permanent magnet 12. The ring-shaped part 19 of the upper pole plate 14 is placed on and connected to the ring surface of the permanent magnet 12. The ring-shaped part 19 of the upper pole plate 14 and the disk 17, which is located on the neodymium disk 16, have the same thickness. A gap 20 exists between the ring-shaped part 19 and the disk 17, which form the upper pole plate 14. When the loudspeaker is installed (not shown), the voice coil enters into this gap 20, also called an air gap.

Equal poles of permanent magnet 12 and the neodymium disk 16 face in different directions with respect to the axis of the magnet system 10. This means that the south pole (S) of the neodymium disk 16 faces the lower pole plate 11 and that the south pole (S) of the permanent magnet 12 faces the upper pole plate 14.

Figure 2:
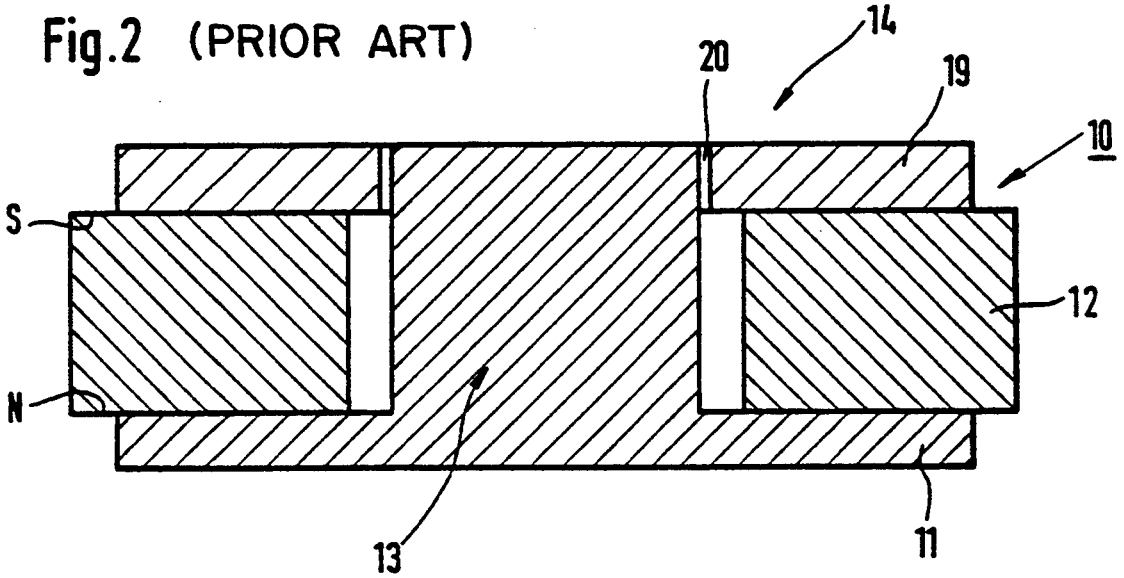
Fig.2 (PRIOR ART)
FIG. 2 is a cross-sectional view of a magnet system according to the state of the art.

FIG. 2 depicts a magnet system 10, which is built in the conventional manner. This magnet system 10 consists of a ring-shaped permanent magnet 12 also made of ferrite, the lower pole plate 11 and a pole core 13 which is made in one piece with the lower pole plate 11. In this magnet system 10 as well, the pole core 13 and the upper pole plate have the same height when the magnet system 10 is installed. Exactly like the magnet system 10 shown in FIG. 1, the magnet system 10 in FIG. 2 also serves to drive a conical loudspeaker, which has a wide band design.

A comparison between FIG. 1 and FIG. 2, which are drawn in the same scale, makes clear that the magnet system 10 in FIG. 1 is clearly smaller than the magnet system 10 in FIG. 2, and can therefore be built considerably lighter if, as indicated by the invention, the pole core 13 has a neodymium disk 16. The weight advantage achieved by using the neodymium disk 16 in the pole core 13 can be seen in the following table, which compares a conventional magnet system 10 according to FIG. 2 with the magnet system 10 in FIG. 1, which has identical properties and function.

| | Magnet system in FIG. 2 | Magnet system in FIG. 1 |
|---|---|---|
| Induction in the air gap | 1 Tesla | 1 Tesla |
| Upper pole plate (18) | | |
| thickness | 4 mm = x | 4 mm = x |
| outside diameter | A | 0.69 A |
| inside diameter | B | B |
| Lower pole plate (11) | | |
| thickness | C | C |
| outside diameter | A | 0.69 A |
| Permanent magnet (12) | | |
| thickness | D | 0.75 D |
| outside diameter | E | 0.69 D |
| inside diameter | F | 0.91 F |
| Pole core (13) diameter | G | G (at least for base 15 and disk 17)) |
| Neodymium disk (16) | | |
| thickness | — | 3 mm = H |
| diameter | — | 0.95 G |
| Height (measured from the side of the lower pole plate connected to the permanent magnet) | D + X | 0.75 D + X* (* = thickness of disk (17)) |
| Air gap width (20) | I | I |
| Weight | J | 0.51 J |

This table clearly shows that with equal induction in air gap 20 and equal air gap dimensions, the magnet system 10 of the invention (FIG. 1) has only 51% of the weight of a conventional magnet system 10 (FIG. 2).

Figure 3:
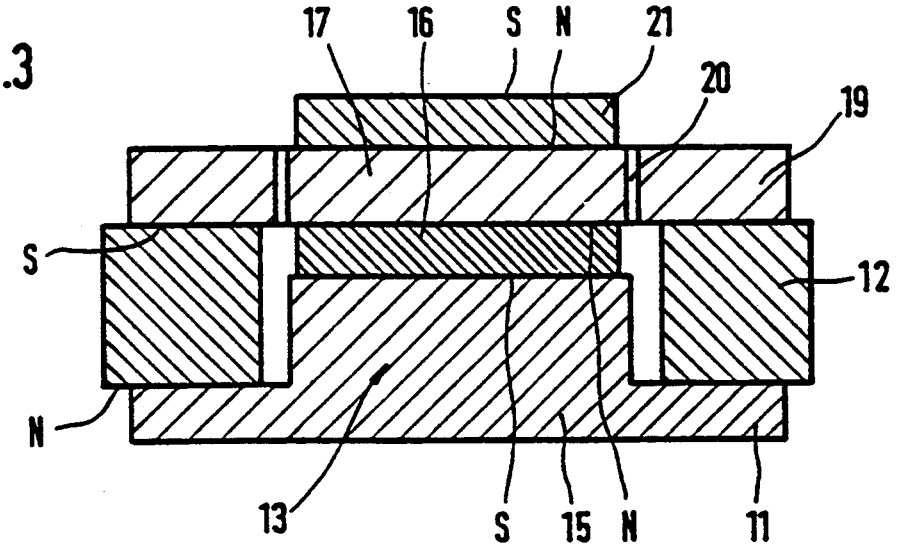
FIG. 3 is a cross-sectional view of another magnet system according to the invention.

FIG. 3 depicts another magnet system 10, which has an additional neodymium disk 21, as compared to the magnet system 10 shown in FIG. 1. This additional neodymium disk 21 is placed on disk 17 in such a way, that equal poles (both north poles (N/N) in the illustrated configuration example) of neodymium disk 16 and the additional neodymium disk 21 face each other. This measure increases the induction in the air gap more, than if the mass of the additional neodymium disk 21 had been placed in the pole core 13.

Although the dimensions of the additional neodymium disk 21 in FIG. 3 correspond to the dimensions of the neodymium disk 16 located in the pole core 13, the invention is not restricted to this dimensional equality. In a different configuration example—not shown—, the dimensions of both neodymium disks 16, 21 could be different from each other. In particular, the height of the two neodymium disks 16, 21 may be different. The selection of the thickness of neodymium disks 16, 21 depends on which induction must be produced in the air gap 20.

I claim:

1. A magnet system (10) for conical loudspeakers, comprising a ring-shaped permanent magnet (12) made of ferrite, a lower pole plate (11), which is connected to a lower ring surface of the permanent magnet (12), a pole core (13), which is centered along the loudspeaker axis and is connected to the lower pole plate (11), and an upper pole plate (14), which is located on the upper ring surface of the permanent magnet (12), characterized in that at least part of the pole core (13) is made of neodymium, equal poles of the pole core (13) and the permanent magnet (12) face in opposite directions with respect to the loudspeaker axis, and the upper pole plate (14) includes two coplanar parts, having one part (19) that is ring-shaped and connected to the permanent magnet (12), and having another part (17) that is disk-shaped and connected to the pole core (13).

2. A magnet system (10) for conical loudspeakers as in claim 1, characterized in that the pole core (13) is a neodymium disk (16), which rests on a base (15) formed on the lower pole plate (11).

3. A magnet system (10) for conical loudspeakers as in claim 2, characterized in that another neodymium disk (21) is located on the side of the disk-shaped part (17) of the upper pole plate (14), which faces away from the lower pole plate (11), where equal poles of the other neodymium disk and the pole core (13) face each other.

4. A magnet system (10) for conical loudspeakers as in claim 1, characterized in that another neodymium disk (21) is located on the side of the disk-shaped part (17) of the upper pole plate (14), which faces away from the lower pole plate (11), where equal poles of the other neodymium disk and the pole core (13) face each other.

5. A lightweight magnet system (10) for a long excursion conical loudspeaker having an air gap (20) with air gap dimensions and having a voice coil that moves more than 3 millimeters for reproducing wide band audio signals, comprising a ring-shaped permanent magnet (12) made of ferrite;

a lower pole plate (11) connected to a lower ring surface of the permanent magnet (12);

an upper pole plate (14) located on an upper ring surface of the permanent magnet (12), including one part (19) that is ring-shaped and connected to the permanent magnet (12), and another part (17) that is disk-shaped and connected to the pole core (13) the one and another parts being coplanar;

a pole core (13) centered along the loudspeaker axis and connected to the lower pole plate (11), having equal poles of the pole core (13) and the permanent magnet (12) faced in opposite directions with respect to the loudspeaker axis, said pole core (13) having at least a part thereof made of neodymium;

whereby the magnetic system (10) has a substantially reduced weight when compared to a conventional magnetic system having a similar air gap with substantially similar air gap dimensions.

* * * * *